US007786957B2

(12) United States Patent
Sakata

(10) Patent No.: US 7,786,957 B2
(45) Date of Patent: Aug. 31, 2010

(54) PLASMA DISPLAY DEVICE

(75) Inventor: Kazuaki Sakata, Chuo (JP)

(73) Assignee: Panasonic Corporation, Osaka (JP)

( * ) Notice: Subject to any disclaimer, the term of this patent is extended or adjusted under 35 U.S.C. 154(b) by 962 days.

(21) Appl. No.: 11/480,878

(22) Filed: Jul. 6, 2006

(65) Prior Publication Data

US 2007/0008244 A1 Jan. 11, 2007

(30) Foreign Application Priority Data

Jul. 7, 2005 (JP) ..... 2005-198945

(51) Int. Cl.
*G09G 3/28* (2006.01)

(52) U.S. Cl. ..... 345/67; 345/60; 315/169.1; 315/169.3; 315/169.4; 313/586

(58) Field of Classification Search ..... 345/60, 345/61–68; 315/169.3, 169.4, 169.1
See application file for complete search history.

(56) References Cited

U.S. PATENT DOCUMENTS 5,424,006 A * 6/1995 Murayama et al. .... 252/301.4 R
6,011,355 A * 1/2000 Nagai ..... 315/169.3
6,486,611 B2 * 11/2002 Tokunaga et al. ..... 315/169.4
7,045,078 B2 * 5/2006 Choi ..... 252/301.4 R
7,567,036 B2 * 7/2009 Hirota et al. ..... 313/586
2002/0008817 A1 * 1/2002 Ito et al. ..... 349/122
2003/0001804 A1 * 1/2003 Naganuma ..... 345/63
2004/0051689 A1 * 3/2004 Nakamura et al. ..... 345/89
2004/0075388 A1 * 4/2004 Miyashita et al. ..... 313/586
2004/0164929 A1 * 8/2004 Ide et al. ..... 345/60
2005/0248510 A1 * 11/2005 Sakata et al. ..... 345/67
2005/0253787 A1 * 11/2005 Nishimura et al. ..... 345/67
2005/0264487 A1 * 12/2005 Tokunaga et al. ..... 345/63
2007/0013306 A1 * 1/2007 Hai et al. ..... 313/582

FOREIGN PATENT DOCUMENTS

JP 2000-227778 8/2000

OTHER PUBLICATIONS

Grant et al. ("Time resolved luminescence spectroscopy of alkaline earth oxides after pulsed electron beam irradiation. II. Spectra and thresholds of MgO", J. Chem. Phys. 90 (1989) 807).*

* cited by examiner

*Primary Examiner*—Henry N Tran
*Assistant Examiner*—Viet Pham
(74) *Attorney, Agent, or Firm*—Drinker Biddle & Reath LLP

(57) ABSTRACT

A plasma display device which generates reset discharge in a reset period prior to an address period in the beginning subfields of a one-field display period, and applies two sustain pulses, which have rising timings different from each other by a predetermined period of time and have partly overlapping application periods, to row electrodes forming each row electrode pair after ending a sustain period in a last subfield of the one-field display period to thereby cause erasure discharge in discharge cells where sustain discharge has been caused in the last subfield.

2 Claims, 11 Drawing Sheets

CROSS - SECTION ALONG V3 - V3

CROSS - SECTION ALONG W2 - W2

PLASMA DISPLAY DEVICE

BACKGROUND OF THE INVENTION

1. Field of the Invention

The present invention relates to a plasma display device using a plasma display panel.

2. Description of the Related Background Art

There is known an AC (alternating current) type PDP (plasma display panel) as one display panel in a scheme of matrix display. The AC type PDP has a plurality of column electrodes (address electrodes) and a plurality of row electrode pairs which are arranged orthogonal to the column electrodes and which each form a scanning line. Each of the row electrode pairs and each of the column electrodes are covered by a dielectric layer for a discharge space, providing a structure forming a discharge cell, corresponding to one pixel, at an intersection of each of the row electrode pairs and each of the column electrodes.

Here, there is so-called a subfield method in which one field period is divided into N subfields to perform light emission for a time period corresponding to weighting for each bit figure of N-bit pixel data, as one method to realize halftone display on the PDP.

FIG. 1 shows a format of light emission drive in one field period of the subfield method.

In the example shown in FIG. 1, the light emission drive is implemented by dividing the one field period into six subfields of SF1, SF2, . . . , SF6 on an assumption the pixel data to be supplied has 6 bits. By performing light emission with the six subfields, expression is available with 64 gray-scale levels for an image of one field.

Each of the subfield is constituted by a reset stage Rc, an address stage Wc and a sustain stage Ic. By simultaneously generating discharge (reset discharge) in all the discharge cells of the PDP in the reset stage Rc, wall electric charge is formed uniformly in each of the discharge cells. In the next address stage Wc, discharge for selective erasure is caused for some of the discharge cells in accordance with the pixel data. The wall electric charge is canceled in discharge cells where the erasure discharge has been done, thus placing those discharge cells as "unlighted cells". Meanwhile, the other discharge cells that the erasure discharge has not been done remain in a state the wall electric charge still stays, thus being rendered as "lighting cells". In the sustain stage Ic, light emission is continued by sustain discharge as to the lighting cells for a time period corresponding to weighting in the subfield. Thus, in each of the subfields SF1-SF6, the light emission is done for a period corresponding to an emission period ratio of 1:2:4:8:16:32 in the order.

In the address stage Wc, in the case of adopting a selective-erasure address scheme to selectively erase the wall electric charge formed in the discharge cells, it is necessary to perform a reset stage Rc, shown by hatching in FIG. 1, in the beginning of each of the subfields. However, the reset discharge, which is performed in all the discharge cells in the reset stage Rc, is comparatively intense discharge, i.e. a high level of light emission. Thus, there is a problem that image contrast is lowered since the light emission occurs regardless of pixel data at six points shown by hatching in FIG. 1.

For this problem, there is a proposed sequence that reset discharge is generated to form wall electric charge in each discharge cell in the beginning of one field so that selective erasure addressing can be done only in one of the subfields thereby improving the contrast, as disclosed in Japanese Patent Application Kokai No. 2000-227778.

However, with the sequence, priming effect based on the reset discharge is reduced. Therefore, in order to reliably cause discharge by application of each drive pulse, it is necessary to increase the width of each drive pulse.

SUMMARY OF THE INVENTION

It is an object of the present invention is to provide a plasma display device and a plasma display panel driving method which are capable of improving image contrast while preventing from causing erroneous discharge.

A plasma display device according to the present invention is a device comprising: a plasma display panel having a plurality of row electrode pairs, a plurality of column electrodes intersecting with the plurality of row electrode pairs, so as to form discharge cells at the intersections, respectively, and a magnesium oxide layer including magnesium oxide crystals provided at a portion facing each of the discharge cells, the magnesium oxide crystals being excited by irradiating electron beams at a portion facing each of the discharge cells to perform cathode luminescence light emission having a peak within a wavelength region of 200-300 nm; a resetting portion which applies, in a reset period, a reset pulse between row electrodes forming each of the plurality of row electrode pairs to cause reset discharge, so that a wall electric charge state in each of the discharge cells is initialized; an addressing portion which applies, in an address period, a scanning pulse to one electrodes of the row electrode pairs and data pulses to the column electrodes in accordance with display data based on a video signal to cause a selective discharge operation for setting wall electric charge of each of the discharge cells into one of a lighting state in which wall electric charge is formed and an unlighted state in which wall electric charge is not formed; and a sustaining portion which applies, in a sustain period, a sustain pulse alternately to row electrodes forming each of the row electrode pairs to cause sustain discharge only in discharge cells set in the lighting state, wherein a one-field display period of the video signal is constituted by a plurality of subfields each including the address period and the sustain period, the resetting portion causes the reset discharge in a reset period prior to an address period in a beginning subfield of the one-field display period, the sustaining portion applies other sustain pulses to row electrodes forming each of the row electrode pairs after ending a sustain period in a last subfield of the one-field display period to thereby cause erasure discharge within discharge cells where the sustain discharge has been caused in the last subfield, the two sustain pulses having rise timings are different from each other by a predetermined period of time and having partly overlapping application periods.

A plasma display panel driving method according to the present invention is a method for driving a plasma display panel in accordance with an input video signal to display an image thereon, the plasma display panel having a plurality of row electrode pairs, and a plurality of column electrodes intersecting with said plurality of row electrode pairs, so as to form discharge cells at the intersections, respectively, and a display period for one field of the input video signal being configured of a plurality of subfields each formed of an address period and a sustain period for the image display, the method comprising the steps of: selectively generating address discharge in each of said discharge cells in accordance with pixel data based on the video signal in the address period to cause a selective discharge operation for setting wall electric charge of each of the discharge cells into one of a lighting state in which wall electric charge is formed and an unlighted state in which wall electric charge is not formed;

applying a sustain pulse between row electrodes forming each of said row electrode pairs in said sustain period to cause sustain discharge only in discharge cells set in the lighting state; and applying other two sustain pulses to row electrodes forming each of the row electrode pairs after ending a sustain period in one subfield of the one-field display period to thereby cause erasure discharge within discharge cells where the sustain discharge has been caused in the one subfield, wherein the two sustain pulses have a same polarity, have rise timings different from each other by a predetermined period of time, and have partly overlapping application periods.

In the plasma display device and the plasma display panel driving method according to the present invention, the two other sustain pulses, which have rise timings different from each other by a predetermined period of time and have partly overlapping application periods, are applied to row electrodes forming each of the row electrode pairs after ending of the sustain period in one subfield of the one-field display period, so that erasure discharge is generated in the discharge cells where sustain discharge has been caused in the one subfield. This allows to set all the discharge cells into a uniform wall charge state, by the reset discharge in the beginning subfield of the next field. Namely, the erasure discharge can make uniform the wall charge states in discharge cells which have emitted light and the other discharge cells which have not emitted light in the last subfield of the preceding field. Accordingly, a voltage range as a margin for proper discharge can be extended thus improving the contrast while preventing from causing erroneous discharge. Further, since a narrow-width pulse for the erasure discharge is equivalently produced by applying the different sustain pulses deviated from each other by the predetermined period of time in rise timing, it is unnecessary to form a structure for especially producing the narrow-width erasure discharge pulse.

DETAILED DESCRIPTION OF THE INVENTION

Hereinafter, an embodiment according to the present invention will be described in detail with reference to the drawings.

Figure 1:
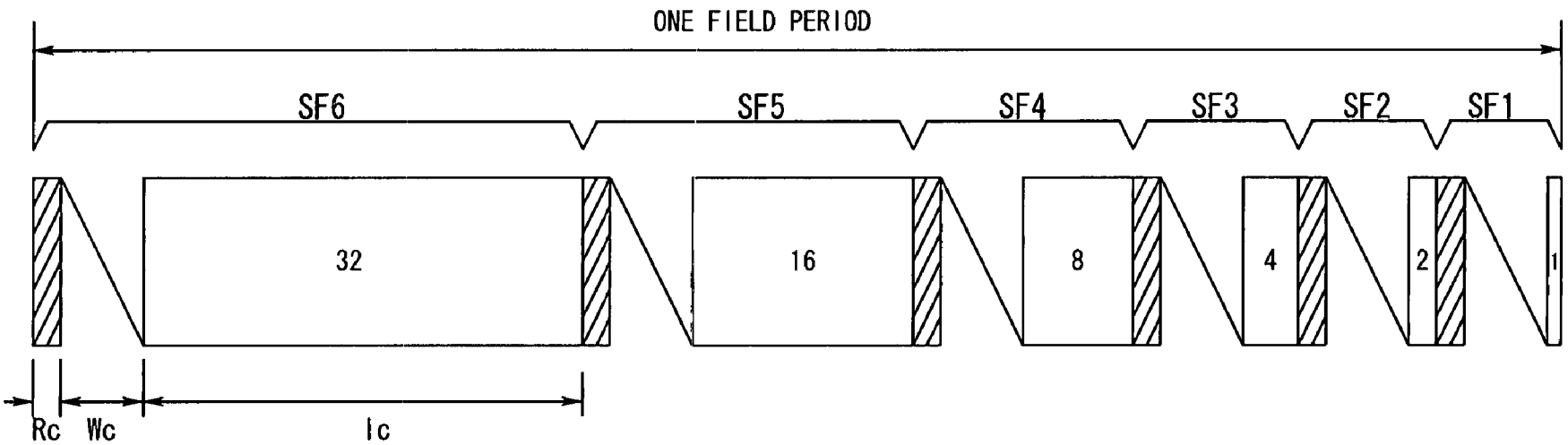
FIG. 1 is a diagram showing an example of an emission-drive sequence adopted on the existing plasma display.
Figure 2:
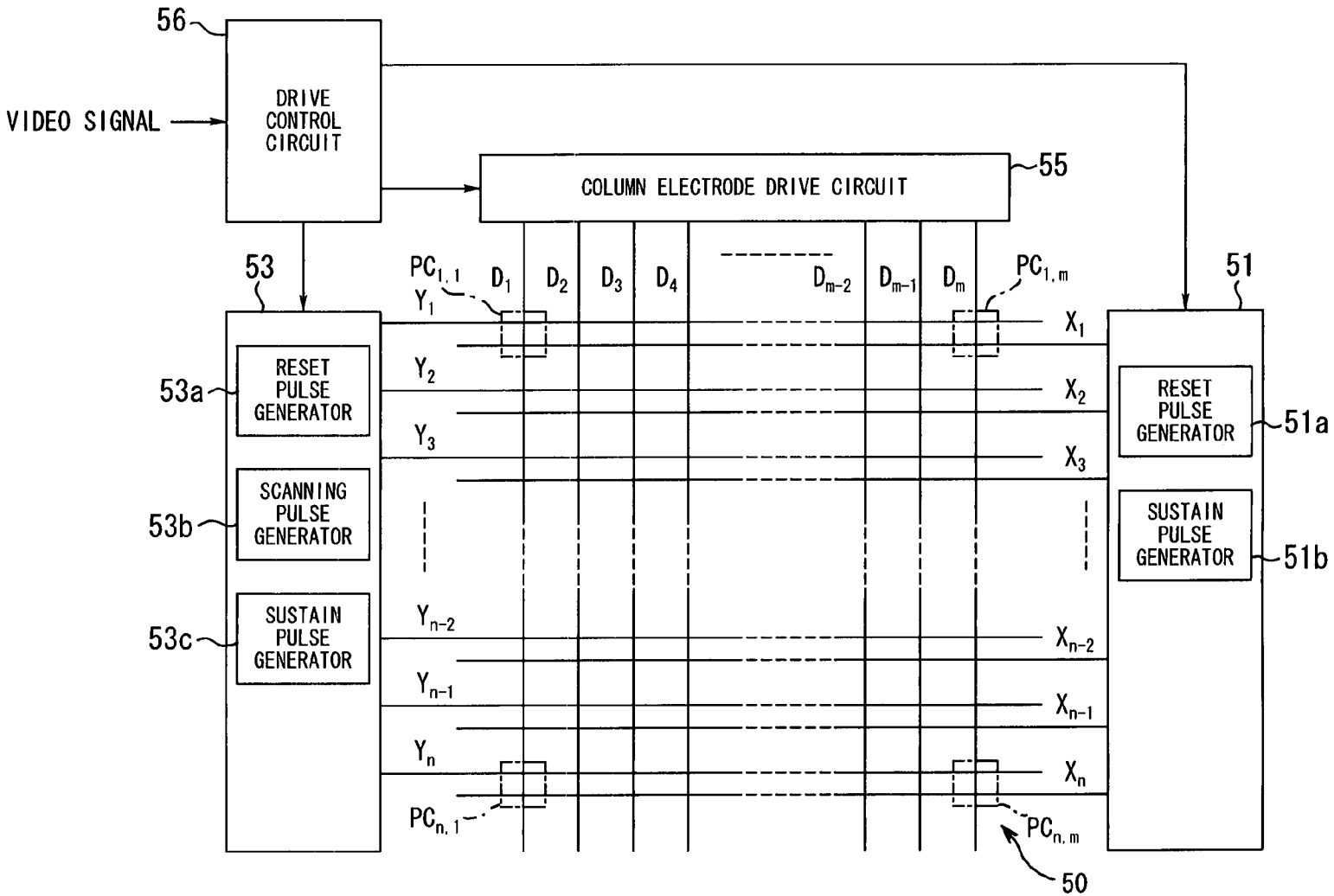
FIG. 2 is a diagram illustrating an outline configuration of a plasma display device according to the invention.

FIG. 2 is a diagram illustrating an outline configuration of a plasma display device according to the invention.

As shown in FIG. 2, the plasma display device is configured of a PDP 50 as a plasma display panel, an X-row electrode drive circuit 51, a Y-row electrode drive circuit 53, a column electrode drive circuit 55, and a drive control circuit 56.

In the PDP 50, column electrodes $D_1$ to $D_m$ are extended and arranged in the longitudinal direction (vertical direction) of a two-dimensional display screen, and row electrodes $X_1$ to $X_n$ and row electrodes $Y_1$ to $Y_n$ are extended and arranged in the lateral direction (the horizontal direction) thereof. The row electrodes $X_1$ to $X_n$ and row electrodes $Y_1$ to $Y_n$ form row electrodes pairs $(Y_1, X_1)$, $(Y_2, X_2)$, $(Y_3, X_3)$, . . . , $(Y_n, X_n)$ which are paired with those adjacent to each other and which serve as the first display line to the nth display line in the PDP 50. In each intersection part of the display lines with the column electrodes $D_1$ to $D_m$ (areas surrounded by dashed lies in FIG. 2), a discharge cell PC which serves as a pixel is formed. More specifically, in the PDP 50, the discharge cells $PC_{1,1}$ to $PC_{1,m}$ belonging to the first display line, the discharge cells $PC_{2,1}$ to $PC_{2,m}$ belonging to the second display line, and the discharge cells $PC_{n,1}$ to $PC_{n,m}$ belonging to the nth display line are each arranged in a matrix.

Each of the column electrodes $D_1$ to $D_m$ of the PDP 50 is connected to the column electrode drive circuit 55, each of the row electrodes $X_1$ to $X_n$ is connected to the X-row electrode drive circuit 51, and each of the row electrodes $Y_1$ to $Y_n$ is connected to the Y-row electrode drive circuit 53.

Figure 3:
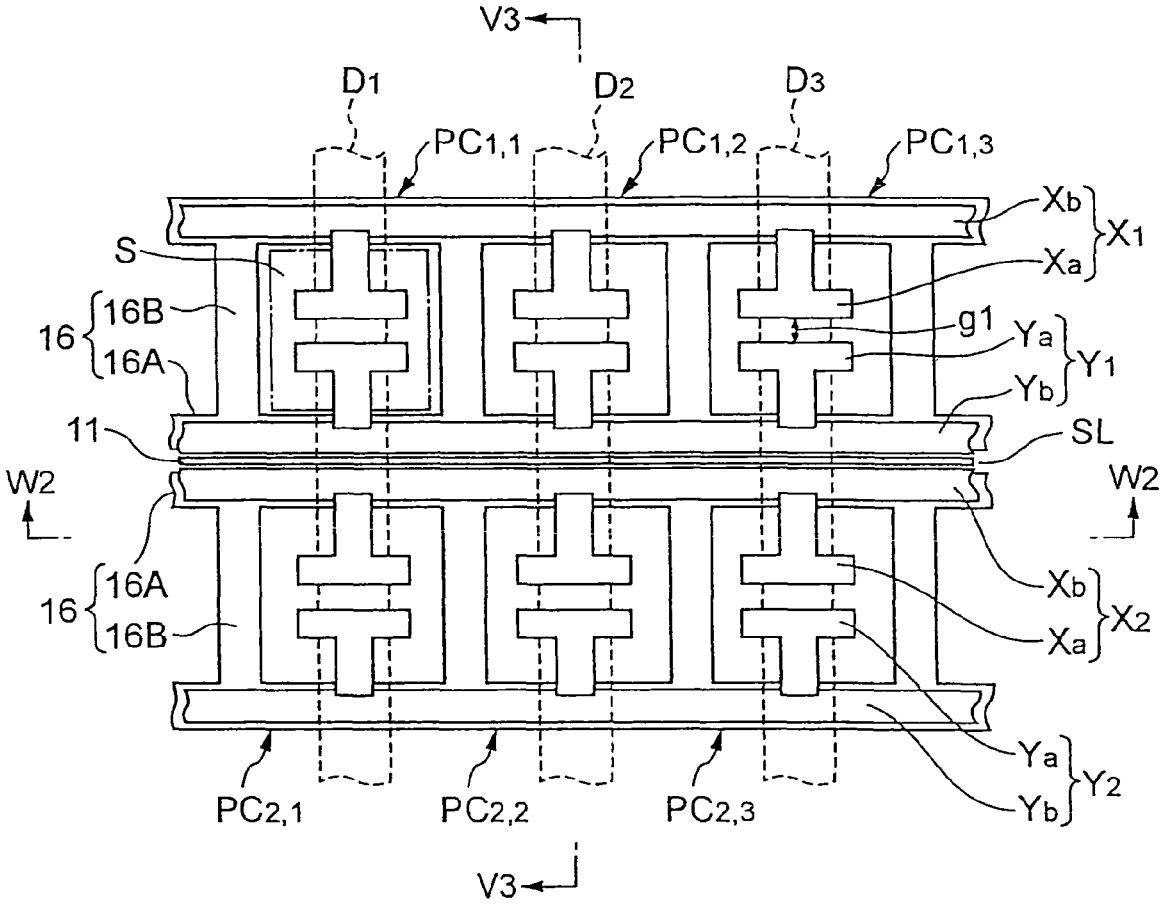
FIG. 3 is a front view schematically illustrating the internal configuration of PDP seen from the display surface side of the device shown in FIG. 2.
Figure 4:
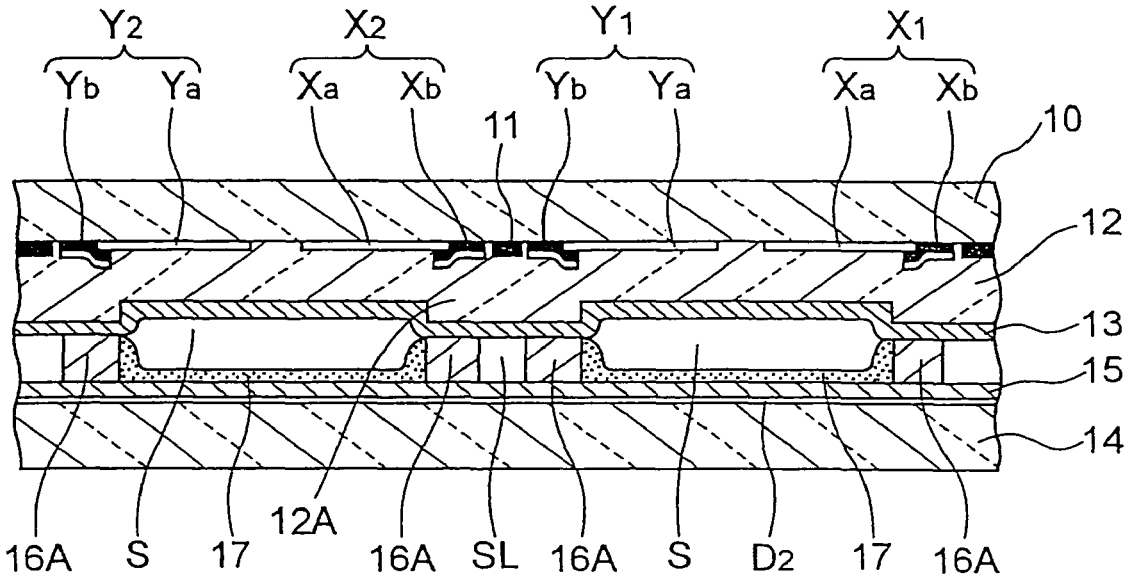
FIG. 4 is a diagram illustrating a cross section on line V3-V3 shown in FIG. 3.
Figure 5:
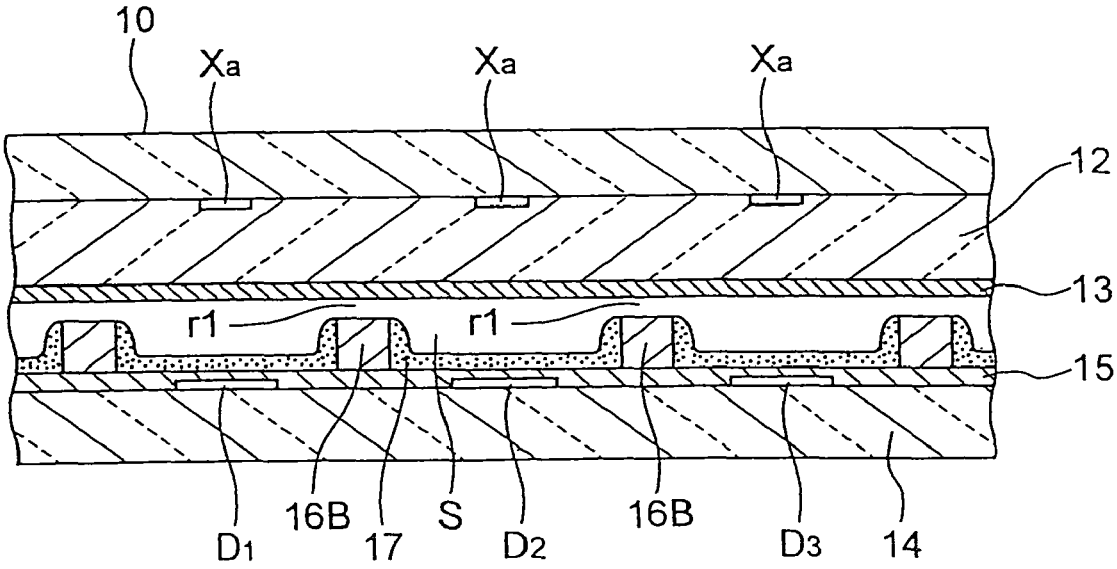
FIG. 5 is a diagram illustrating a cross section on line W2-W2 shown in FIG. 3.

FIG. 3 is a front view schematically illustrating the internal configuration of the PDP 50 seen from the display surface side. FIG. 3 depicts each of the intersection parts of each of the column electrodes $D_1$ to $D_3$ with the first display line $(Y_1, X_1)$ and the second display line $(Y_2, X_2)$ in the PDP 50. FIG. 4 depicts a diagram illustrating a cross section of the PDP 50 at a line V3-V3 in FIG. 3, and FIG. 5 depicts a diagram illustrating a cross section of the PDP 50 at a line W2-W2 in FIG. 3.

As shown in FIG. 3, each of the row electrodes X is configured of a bus electrode Xb (main portion) extended in the horizontal direction in the two-dimensional display screen and a T-shaped transparent electrode Xa (projected portion) formed as contacted with the position corresponding to each of the discharge cells PC on the bus electrode Xb. Each of the row electrodes Y is configured of a bus electrode Yb extended in the horizontal direction of the two-dimensional display screen and a T-shaped transparent electrode Ya formed as contacted with the position corresponding to each of the discharge cells PC on the bus electrode Yb. The transparent electrodes Xa and Ya oppose each other via a discharge gap g1 which has a predetermined length. The transparent electrodes Xa and Ya are formed of a transparent conductive film such as ITO, and the bus electrodes Xb and Yb are formed of a metal film, for example. As shown in FIG. 4, for the row electrode X formed of the transparent electrode Xa and the bus electrode Xb, and for the row electrode Y formed of the transparent electrode Ya and the bus electrode Yb, the front sides thereof are formed on the rear side of a front transparent substrate 10 to be the display surface of the PDP 50. The transparent electrodes Xa and Ya in each row electrode pair (X, Y) are extended to the counterpart row electrode side to be paired, and each have a wide portion near the discharge gap g1, and a narrow portion connecting between the wide portion and the bus electrode. The flat tops of the wide portions of the transparent electrodes Xa and Ya are faced to each other through the discharge gap g1. Moreover, on the rear side of the front transparent substrate 10, a black or dark light absorbing layer (shade layer) 11 extended in the horizontal direction of the two-dimensional display screen is formed between a pair of the row electrode pair ($X_1$, $Y_1$) and the row electrode pair ($X_2$, $Y_2$) adjacent to this row electrode pair. Furthermore, on the rear side of the front transparent substrate 10, a dielectric layer 12 is formed so as to cover the row electrode pair (X, Y). On the rear side of the dielectric layer 12 (the surface opposite to the surface to which the row electrode pair is contacted), an increased dielectric layer 12A is formed at the portion corresponding to the area where a light absorbing layer 11 and the bus electrodes Xb and Yb adjacent to the light absorbing layer 11 are formed as shown in FIG. 4. On the surface of the dielectric layer 12 and the increased dielectric layer 12A, a magnesium oxide layer 13 including vapor phase magnesium oxide (MgO) monocrystal powder, described later, is formed.

On the other hand, on a rear substrate 14 disposed in parallel with the front transparent substrate 10, each of the column electrodes D is formed as extended in the direction orthogonal to the row electrode pair (X, Y) at the position facing the transparent electrodes Xa and Ya in each row electrode pair (X, Y). On the rear substrate 14, a white column electrode protective layer 15 which covers the column electrode D is further formed. On the column electrode protective layer 15, partition 16 is formed. The partition 16 is formed in a ladder shape of a lateral wall 16A extended in the lateral direction of the two-dimensional display screen at the position corresponding to the bus electrodes Xb and Yb of each row electrode pair (X, Y), and of a vertical wall 16B extended in the longitudinal direction of the two-dimensional display screen at the middle between the column electrodes D adjacent to each other. In addition, the partition 16 in a ladder shape as shown in FIG. 3 are formed at every display line of the PDP 50, and a space SL exists between the partitions 16 adjacent to each other as shown in FIG. 3. Besides, the partitions 16 in a ladder shape partition the discharge cells PC including a discharge space S, and the transparent electrodes Xa and Ya, each of them is separated. In the discharge space S, discharge gas including xenon gas is filled. On the side surface of the lateral wall 16A, the side surface of the vertical wall 16B, and the surface of the column electrode protective layer 15 in each of the discharge cells PC, a fluorescent material layer 17 is formed so as to cover the entire surfaces thereof as shown in FIG. 4. The fluorescent material layer 17 is actually formed of three types of fluorescent materials: a fluorescent material for red light emission, a fluorescent material for green light emission, and a fluorescent material for blue light emission. The discharge space S and the space SL in each of the discharge cells PC are closed to each other by abutting the magnesium oxide layer 13 against the lateral wall 16A as shown in FIG. 4. On the other hand, as shown in FIG. 5, since the vertical wall 16B is not abutted against the magnesium oxide layer 13, a space r1 exists therebetween. More specifically, the discharge spaces S of each of the discharge cells PC adjacent to each other in the lateral direction of the two-dimensional display screen communicate with each other through the space r1.

Figure 6:
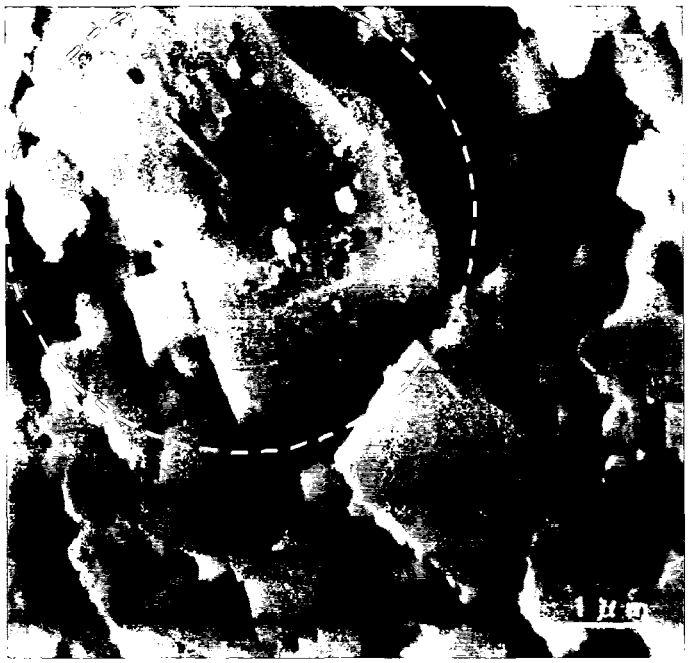
FIG. 6 is a diagram illustrating magnesium oxide monocrystals having a cubic polycrystal structure.
Figure 7:
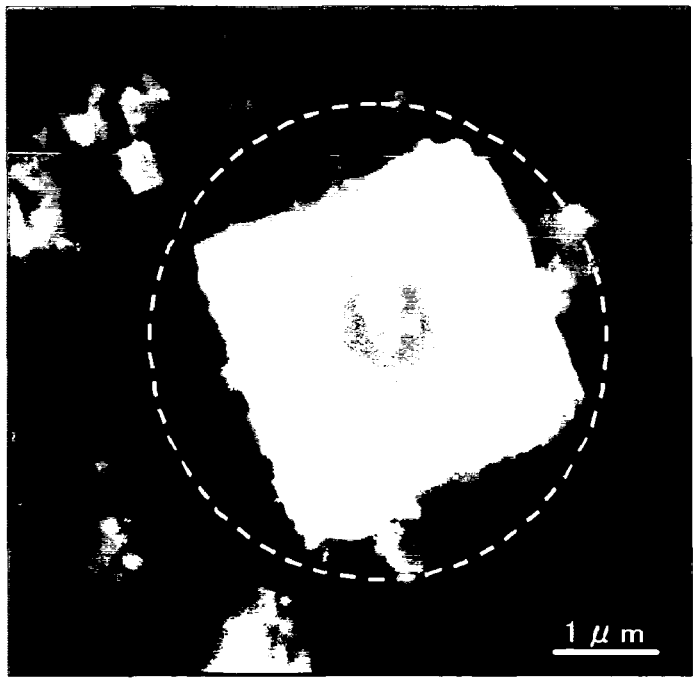
FIG. 7 is a diagram illustrating a magnesium oxide monocrystal having a cubic polycrystal structure.
Figure 8:
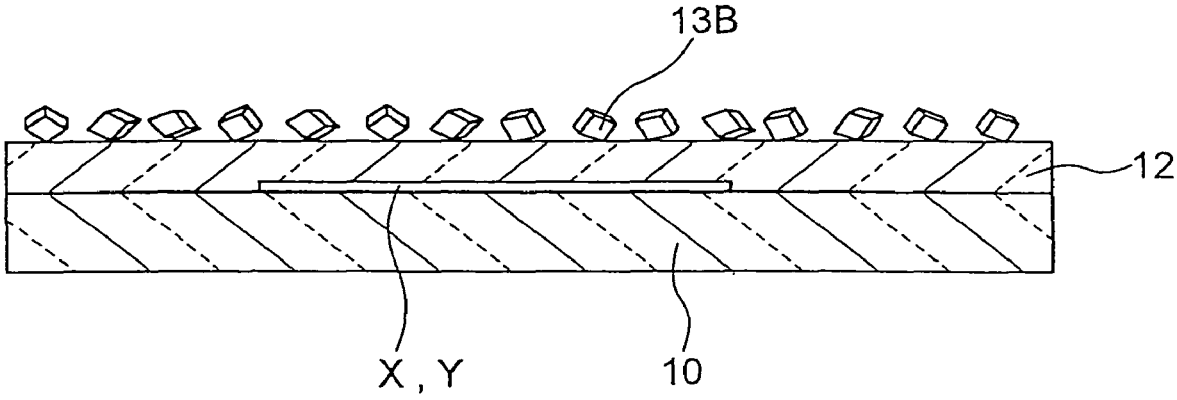
FIG. 8 is a diagram illustrating a form when magnesium oxide monocrystal powder is attached to the surface of a dielectric layer and an increased dielectric layer to form a magnesium oxide layer.

Here, magnesium oxide crystals forming the magnesium oxide layer 13 contain monocrystals obtained by vapor phase oxidation of magnesium steam that is generated by heating magnesium, such as vapor phase magnesium oxide crystals that are excited by irradiating electron beams to do CL light emission having a peak within a wavelength range of 200 to 300 nm (particularly, near 235 nm within 230 to 250 nm). The vapor phase magnesium oxide crystals contain a magnesium monocrystal having a particle diameter of 2000 angstrom or greater with a polycrystal structure in which cubic crystals are fit into each other in a SEM photo image as shown in FIG. 6, or with a cubic monocrystal structure in a SEM photo image as shown in FIG. 7. The magnesium monocrystal has features of higher purity, finer particles and less particle coagulation than magnesium oxides generated by other methods, which contributes to improved discharge properties in discharge delay, etc. In addition, in the embodiment, the vapor phase magnesium oxide monocrystals, which are used, have an average particle diameter of 500 angstrom or greater measured by the BET method, preferably 2000 angstrom or greater. Then, as shown in FIG. 8, the magnesium oxide monocrystals are attached to the surface of the dielectric layer 12 by spraying or electrostatic coating to form the magnesium oxide layer 13. Moreover, the magnesium oxide layer 13 may be formed in which a thin magnesium oxide layer is formed on the surface of the dielectric layer 12 and the increased dielectric layer 12A by vapor deposition or sputtering and vapor phase magnesium oxide monocrystals are attached thereon.

Figure 9:
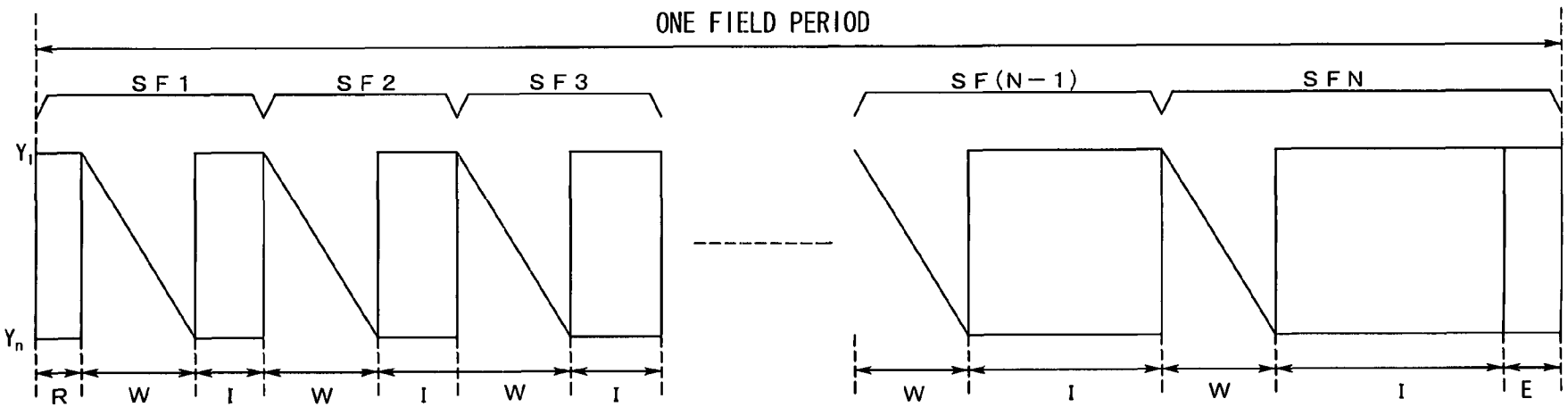
FIG. 9 is a diagram illustrating an exemplary light emission addressing sequence adopted in the plasma display device shown in FIG. 2.

The drive control circuit 56 supplies various control signals that drive the PDP 50 having the structure in accordance with the light emission addressing sequence adopting a subfield method (subframe method) as shown in FIG. 9 to the X-row electrode drive circuit 51, the Y-row electrode drive circuit 53, and the column electrode drive circuit 55. The X-row electrode drive circuit 51, the Y-row electrode drive circuit 53, and the column electrode drive circuit 55 generate various drive pulses to be supplied to the PDP 50 in accordance with the light emission addressing sequence as shown in FIG. 9 and supply them to the PDP 50. The X-row electrode drive circuit 51 has a reset pulse generator (resetting portion) 51*a* and a sustain pulse generator (sustaining portion) 51*b*. The Y-row electrode drive circuit 53 has a reset pulse generator (resetting portion) 53*a*, a scanning pulse generator (addressing portion) 53*b*, and a sustain pulse generator (sustaining portion) 53*c*.

In the light emission addressing sequence shown in FIG. 9, a display period for one field (one frame) has subfields SF1 to SFN (N is an integer lager than one), and the address stage W and the sustain stage I are implemented in each of the subfields SF1 to SFN. Furthermore, only in the starting subfield SF1, a rest stage R is implemented prior to the address stage W. In the last subfield SFN, a main erasure stage E is implemented after ending the sustain stage I.

Figure 10:
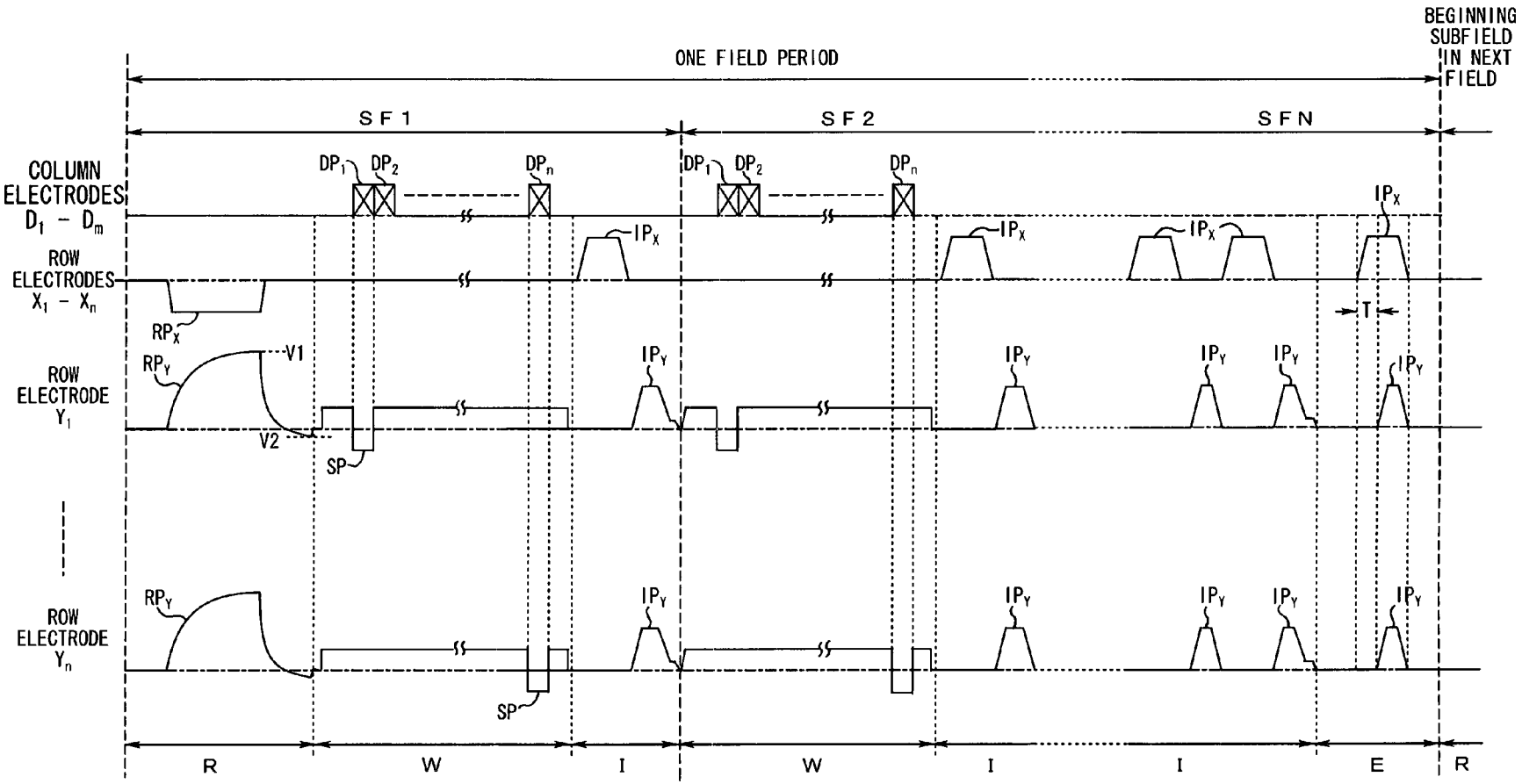
FIG. 10 is a diagram illustrating various drive pulses to be applied to PDP and application timing thereof in accordance with the light emission addressing sequence shown in FIG. 9.

FIG. 10 depicts a diagram illustrating the application timing of various drive pulses to be applied to the column electrodes D, and the row electrodes X and Y of the PDP 50, extracting SF1, SF2 and SFN from the subfields SF1 to SFN.

In the reset stage R implemented prior to the address stage W only in the starting subfield SF1, the reset pulse generator 51*a* of the X-row electrode drive circuit 51 simultaneously applies a negative reset pulse $RP_X$ to the row electrodes $X_1$ to $X_n$ as shown in FIG. 10. The reset pulse $RP_X$ has a pulse waveform that the voltage value is slowly increased to reach a peak voltage value over time. Furthermore, at the same time when the application of the reset pulse $RP_X$, the reset pulse generator 53*a* of the Y-row electrode drive circuit 53 simultaneously applies to the row electrodes $Y_1$ to $Y_n$ a positive reset pulse $RP_Y$ having a waveform that the voltage value is slowly increased to reach a peak voltage value over time as similar to the reset pulse $RP_X$ as shown in FIG. 10. By the simultaneous application of the reset pulse $RP_X$ and the reset pulse $RP_Y$, reset discharge is generated between the row electrodes X and Y in each of all the discharge cells $PC_{1,1}$ to $PC_{n,m}$. After the reset discharge is terminated, a predetermined amount of wall electric charge is formed on the surface of the magnesium oxide layer 13 in the discharge space S in each of the discharge cells PC. More specifically, it is the state that so-called wall electric charge is formed in which positive electric charge is formed near the row electrode X and negative electric charge is formed near the row electrode Y on the surface of the magnesium oxide layer 13.

After that, the Y-row electrode drive circuit 53 gradually changes the reset pulse $RP_Y$ upon trailing thereof. Namely, as shown in FIG. 10, the reset pulse $RP_Y$ reaches an intermediate potential V2 between the scanning pulse and the ground potential. This prevents occurrence of such strong discharge as the wall electric charge is erased during the trailing of the reset pulse $RP_Y$, and adjusts the amount of wall electric charge so that selective discharge for erasure can be well done in the next address stage.

In a panel on which the vapor phase magnesium oxide layer 13 is provided as a protective layer, since discharge probability is significantly high, weak reset discharge is stably generated. By combining a bump, particularly a T-shaped electrode in a broad tip end, reset discharge is localized near the discharge gap, and thus a possibility to generate sudden reset discharge such as discharge being generated in all the row electrodes is further suppressed. Therefore, discharge is hardly generated between the column electrode and the row electrode, and stable, weak reset discharge can be generated for a short time.

Furthermore, in the configuration that the vapor phase magnesium oxide layer 13 is provided, since the discharge probability is significantly improved, the application of a single reset pulse, that is, even a one-time reset discharge allows priming effect to be continued. Thus, the reset operation and the selective erasure operation can be further stabilized. Moreover, the number of times to do reset discharge is minimized to enhance contrast.

In addition, the effect of provision of the vapor phase magnesium oxide layer 13 will be described later.

Next, in the address stage W in each of the subfields SF1 to SFN, the scanning pulse generator 53*b* of the Y-row electrode drive circuit 53 applies positive voltages to all the row electrodes $Y_1$ to $Y_n$, and sequentially applies a scanning pulse SP having a negative voltage to each of the row electrodes $Y_1$ to $Y_n$. While this is being done, the X-electrode drive circuit 51 changes the potentials of the electrodes $X_1$ to $X_n$ to 0 V. The column electrode drive circuit 55 converts each data bit in a pixel drive data bit group DB1 corresponding to the subfield SF1 to a pixel data pulse DP having a pulse voltage corresponding to its logic level. For example, the column electrode drive circuit 55 converts the pixel drive data bit of a logic level of 0 to the pixel data pulse DP of a positive high voltage, while converts the pixel drive data bit of a logic level of 1 to the pixel data pulse DP of a low voltage (0 volt). Then, it applies the pixel data pulse DP to the column electrodes $D_1$ to $D_m$ for each display line in synchronization with the application timing of a scanning pulse SP. More specifically, the column electrode drive circuit 55 first applies the pixel data pulse group DP1 formed of m pulses of the pixel data pulses DP corresponding to the first display line to the column electrodes $D_1$ to $D_m$, and then applies the pixel data pulse group DP2 formed of m pulses of the pixel data pulses DP corresponding to the second display line to the column electrodes $D_1$ to $D_m$. Between the column electrode D and the row electrode Y in the discharge cell PC to which the scanning pulse SP of the negative voltage and the pixel data pulse DP of the high voltage have been simultaneously applied, selective erasure discharge is generated to eliminate wall electric charge formed in the discharge cell PC. On the other hand, in the discharge cell PC to which the scanning pulse SP has been applied as well as the pixel data pulse DP of the low voltage (0 Volt), the selective erasure discharge as above is not generated. Therefore, the state to form wall electric charge is maintained in the discharge cell PC. More specifically, wall electric charge remains as it is when it exists in the discharge cell PC, whereas the state not to form wall electric charge is maintained when wall electric charge does not exist.

In this manner, in the address stage W based on the selective erasure addressing method, selective erasure addressing discharge is selectively generated in each of the discharge cells PC in accordance with each data bit in the pixel drive data bit group corresponding to the subfield, and then wall electric charge is removed. Thus, the discharge cell PC in which wall electric charge remains is set in the lighting state, and the discharge cell PC in which wall electric charge is removed is set in the unlighted state.

Subsequently, in the sustain stage I in each of the subfields, the sustain pulse generator 51*b* of the X-row electrode drive circuit 51 and the sustain pulse generator 53*c* of the Y-row electrode drive circuit 53 alternately, repeatedly apply positive sustain pulses $IP_X$ and $IP_Y$ to the row electrodes $X_1$ to $X_n$ and $Y_1$ to $Y_n$. The number of times to apply the sustain pulses $IP_X$ and $IP_Y$ depends on weighting brightness in each of the subfields. At each time that the sustain pulses $IP_X$ and $IP_Y$ are applied, only the discharge cells PC in the lighting state do sustain discharge, the cells in which a predetermined amount of wall electric charge is formed, and the fluorescent material layer 17 emits light in association with this discharge to form an image on the panel surface.

In the last subfield SFN, the main erasure stage E is given as a period from an end point of the sustain stage to a start point of the beginning subfield SF1 in the next field. In the main erasure stage E, the sustain pulse generators 51*b*, 53*c* of the X-row electrode and Y-row electrode drive circuits 51, 53 apply sustain pulses $IP_X$ and $IP_Y$, of which rise timings are different from each other by a short period T, to the row electrodes $X_1$-$X_n$ and $Y_1$-$Y_n$, respectively. Namely, the start times for rise of the sustain pulses $IP_X$ and $IP_Y$ are different from each other. After the sustain pulse $IP_X$ rises to reach a predetermined potential (peak potential), the sustain pulse $IP_Y$ starts to rise. The application period of the sustain pulse $IP_X$ is partly overlapped with that of the sustain pulse $IP_Y$. Further, the sustain pulses $IP_X$, $IP_Y$ starts to fall at the same timing.

Figure 11:
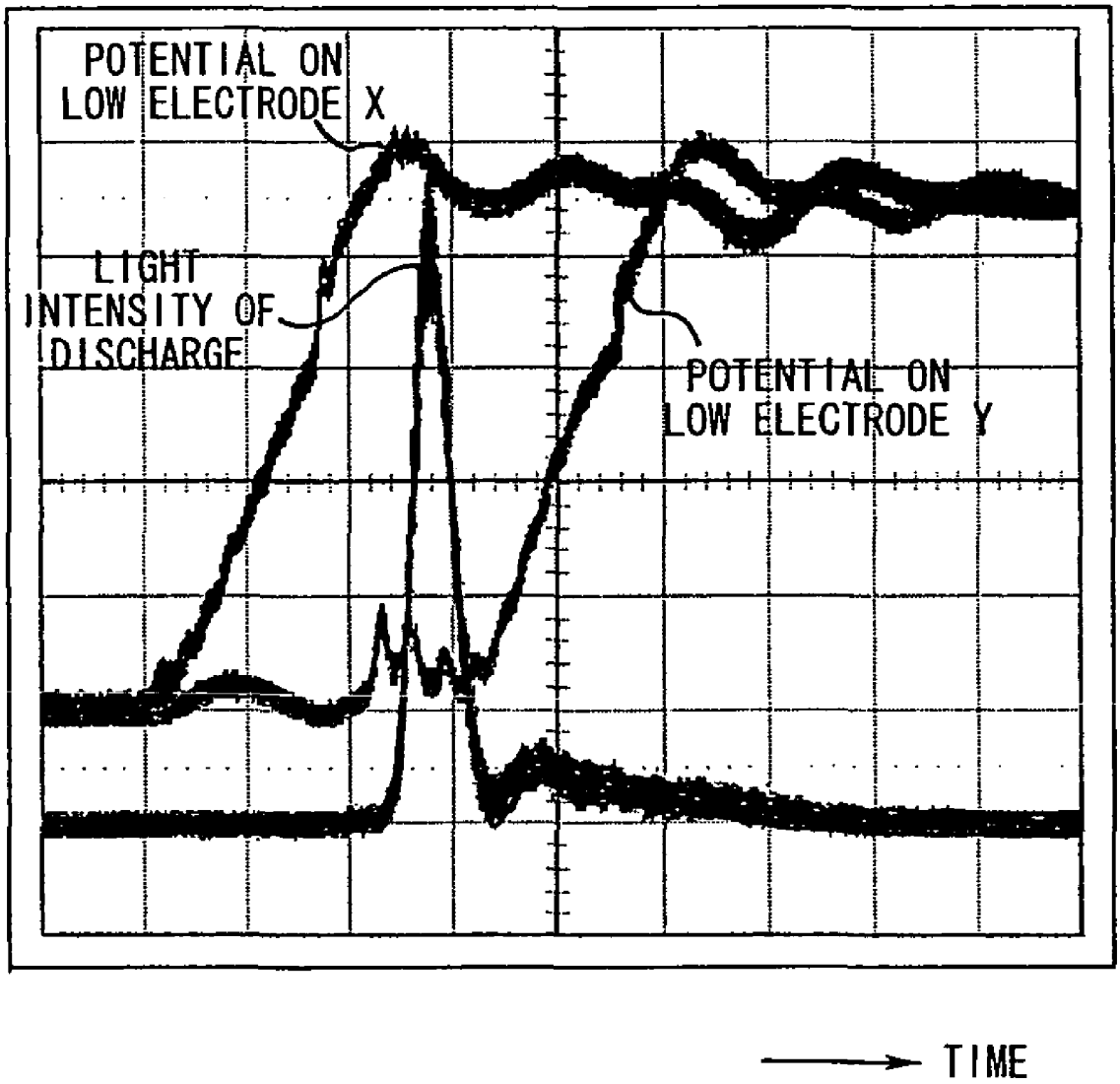
FIG. 11 is a diagram illustrating potential changes and light intensity of discharge in an erasure stage E between row electrodes X, Y which are paired with each other.

A predetermined potential is generated between paired electrodes of the row electrodes $X_1$,$Y_1$-$X_n$,$Y_n$ in the short period T from a rise of the sustain pulse $IP_X$ to a time point immediately before the sustain pulse $IP_Y$ starts to rise. In the sustain period of the last subfield SFN, discharge for erasure takes place only in the discharge cells in the lighting state. FIG. 11 shows potential changes and discharge light intensity between the paired ones of the row electrodes X, Y in the erasure stage E.

In the period T of from the rise point of the sustain pulse $IP_X$ to the time immediately before the sustain pulse $IP_Y$ starts to rise, it is possible to obtain a state equivalent to the case of applying a narrow-width erase pulse between the row electrode X, Y.

In the last subfield SFN, no discharge occurs in the discharge cells PC in the unlighted state. As a result, in the reset discharge in the beginning subfield SF1 of the next field, all the discharge cells can have a uniform wall electric charge state. Particularly, in the case of generating reset discharge by a single reset pulse in the reset period, the stability of a wall electric charge state in each discharge cell by the reset discharge is influenced by the lighting/unlighted state of each discharge cell in the last subfield SFN of the preceding field, i.e. by the presence/absence of wall electric charge. For this reason, in order to make uniform the wall electric charge states in both discharge cells which have emitted light and discharge cells which have not emitted light in the last subfield of the field preceding to the reset stage, the erasure discharge is performed by applying the phase-shifted sustain pulses in place of a narrow-width erasure pulse.

Figure 12:
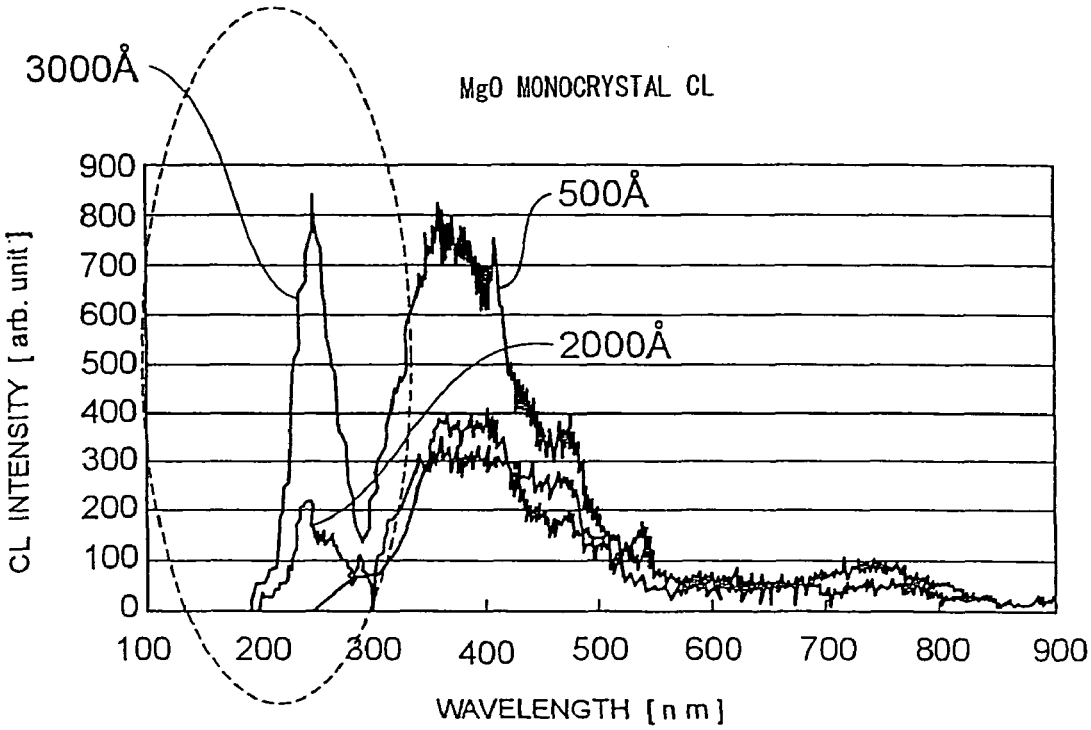
FIG. 12 is a graph illustrating the relationship between the particle diameter of magnesium oxide monocrystal powder and the wavelength of CL light emission.
Figure 13:
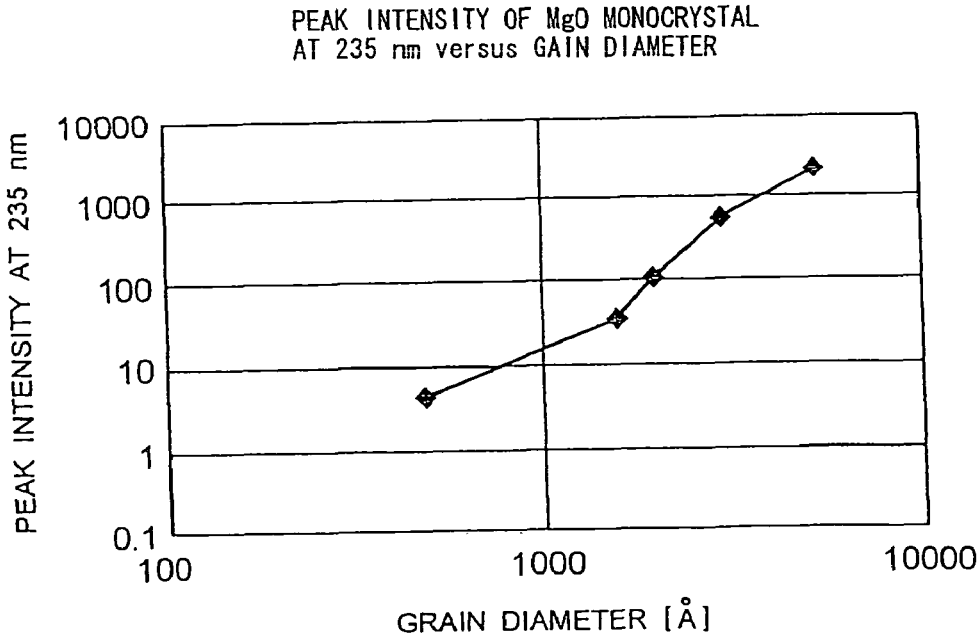
FIG. 13 is a graph illustrating the relationship between the particle diameter of magnesium oxide monocrystal powder and the intensity of CL light emission at 235 nm.

The vapor phase magnesium monocrystals contained in the magnesium oxide layer 13 formed in each of the discharge cells PC are excited by irradiating electron beams to do CL light emission having a peak within a wavelength range of 200 to 300 nm (particularly, near 235 nm within 230 to 250 nm) as shown in FIG. 12. As shown in FIG. 13, the greater the particle diameter of each of the vapor phase magnesium oxide crystals is, the greater the peak intensity of CL light emission is. More specifically, when magnesium is heated at temperature higher than usual in generating the vapor phase magnesium oxide crystals, vapor phase magnesium oxide monocrystals having the average particle diameter of 500 angstrom are formed as well as relatively large monocrystals having the particle diameter of 2000 angstrom or greater as shown in FIG. 6 or FIG. 7. Since temperature to heat magnesium is higher than usual, the length of flame generated by reacting magnesium with oxygen also becomes longer. Thus, the difference between a temperature of the flame and an ambient temperature becomes great, and therefore a group of vapor phase magnesium oxide monocrystals having a greater particle diameter particularly contain many monocrystals of high energy level corresponding to 200 to 300 nm (particularly near 235 nm).

Figure 14:
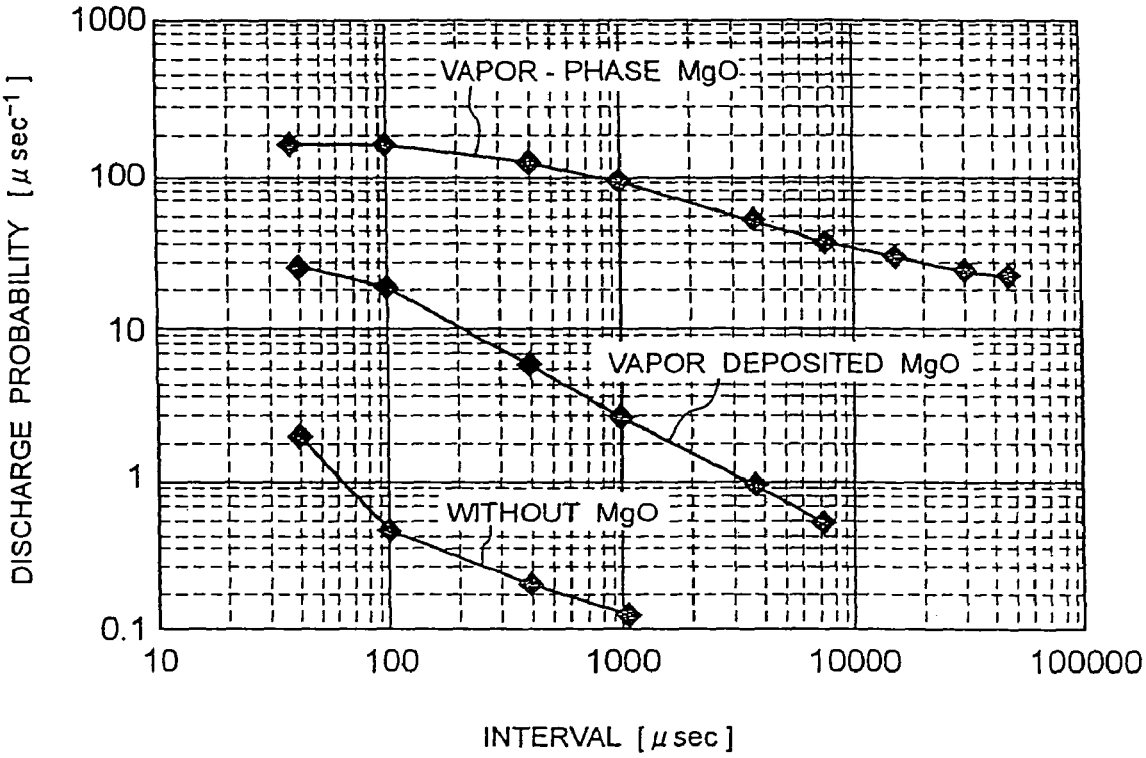
FIG. 14 is a diagram illustrating a discharge probability when no magnesium oxide layer is constructed in a discharge cell, a discharge probability when a magnesium oxide layer is constructed by traditional vapor deposition, and a discharge probability when a magnesium oxide layer of a polycrystal structure is constructed.

FIG. 14 is a diagram illustrating discharge probabilities: the discharge probability when no magnesium oxide layer was provided in the discharge cell PC; the discharge probability when the magnesium oxide layer is constructed by traditional vapor deposition; and the discharge probability when the magnesium oxide layer was provided which contained vapor phase magnesium oxide monocrystals to generate CL light emission having a peak at 200 to 300 nm (particularly near 235 nm within 230 to 250 nm) by irradiating electron beams. In addition, in FIG. 14, the horizontal axis is dwell time of discharge, that is, a time interval from discharge being generated to next discharge being generated.

Figure 15:
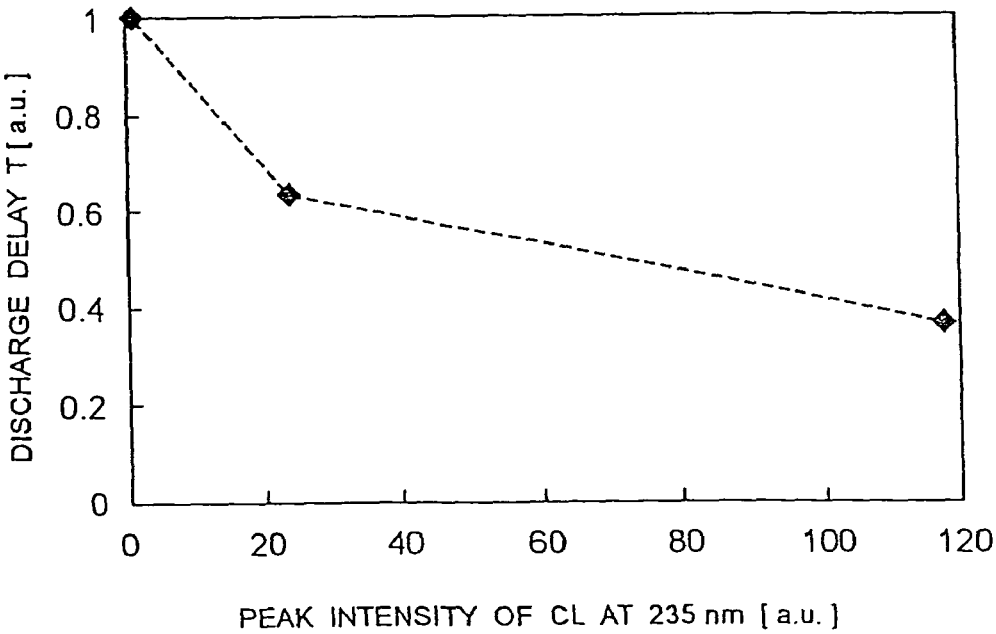
FIG. 15 is a diagram illustrating the correspondence between CL light emission intensity at a 235-nm peak and discharge delay time.

In this manner, when the magnesium oxide layer 13 is formed which contains the vapor phase magnesium oxide monocrystals that do CL light emission having a peak at 200 to 300 nm (particularly near 235 nm within 230 to 250 nm) by irradiating electron beams as shown in FIG. 6 or FIG. 7 in the discharge space S in each of the discharge cells PC, the discharge probability is higher than the case where the magnesium oxide layer is formed by traditional vapor deposition. In addition, as shown in FIG. 15, for the vapor phase magnesium oxide monocrystals described above, those of greater CL light emission intensity having a peak particularly at 235 nm in irradiating electron beams can shorten discharge delay generated in the discharge space S.

Therefore, even though voltage transition of the reset pulse $RP_Y$ to be applied to the row electrode Y is made smooth to weaken reset discharge as shown in FIG. 10 in order to suppress light emission in association with reset discharge that relates to no display image and to improve contrast, this weak reset discharge can be stabilized for a short time to be generated. Particularly, since each of the discharge cells PC adopts the structure in which local discharge is generated near the discharge gap between the T-shaped transparent electrodes Xa and Ya, a strong, sudden reset discharge that might be discharged in all the row electrodes can be suppressed as well as error discharge between the column electrode and the row electrode can be suppressed.

Furthermore, since the increased discharge probability (shortened discharge delay) allows a long, continuous priming effect by reset discharge in the reset stage R, address discharge generated in the address stage W and sustain discharge generated in the sustain stage I are high speed. Therefore, the pulse widths of the pixel data pulse DP and the scanning pulse SP to be applied to the column electrode D and the row electrode Y in order to generate address discharge as shown in FIG. 10 can be shortened. By that amount, processing time for the address stage W can be shortened. Moreover, the pulse width of the sustain pulse $IP_Y$ to be applied to the row electrode Y in order to generate sustain discharge as shown in FIG. 10 can be shortened. By that amount, processing time for the sustain stage I can be shortened.

Accordingly, by the amount of the shortened processing time for each of the address stage W and the sustain stage I, the number of subfields to be provided in one field (or one frame) display period can be increased, and the number of gray scales can be intended to increase.

In addition, for the PDP 50 in the embodiments, the structure is adopted in which the discharge cell PC is formed between the row electrodes X and the row electrodes Y that are paired with each other as $(X_1, Y_1)$, $(X_2, Y_2)$, $(X_3, Y_3)$, . . . , $(X_n, Y_n)$. However, the structure may be adopted in which the discharge cell PC is formed between all the row electrodes. More specifically, the structure may be adopted in which the discharge cell PC is formed between the row electrodes $X_1$ and $Y_1$, the row electrode $Y_1$ and $X_2$, the row electrode $X_2$ and $Y_2$, . . . , the row electrode $Y_{n-1}$ and $X_n$, the row electrode $X_n$ and $Y_n$.

Furthermore, for the PDP 50 in the embodiments, the structure is adopted in which the row electrodes X and Y are formed in the front transparent substrate 10 and the column electrode D and the fluorescent material layer 17 are formed in the rear substrate 14. However, the structure may be adopted in which the column electrodes D as well as the row electrodes X and Y are formed in the front transparent substrate 10 and the fluorescent material layer 17 is formed in the rear substrate 14.

As described above, according to the present invention, sustain pulses, which have rise timings different from each other by a predetermined period of time and have partly overlapping application periods, are applied to row electrodes forming each row electrode pair after ending of the sustain period in the last subfield of the one-field display period, so that erasure discharge is generated in discharge cells where sustain discharge has been caused in the last subfield. This allows to set all the discharge cells into a uniform wall charge state, by reset discharge in a beginning subfield of the next field. Therefore, image contrast can be improved while preventing from causing erroneous discharge.

This application is based on Japanese Patent Application No. 2005-198945 which is hereby incorporated by reference.

What is claimed is:

1. A plasma display device comprising a plasma display panel and a drive portion for driving said plasma display panel in accordance with an input video signal to display a gray-scale image on said plasma display panel, said plasma display panel having: a plurality of row electrode pairs; a plurality of column electrodes intersecting with said plurality of row electrode pairs; a front transparent substrate on which a dielectric layer is formed to cover said plurality of row electrode pairs; a magnesium oxide layer formed on the dielectric layer; and a rear substrate, disposed in parallel with said front transparent substrate, on which a protective layer is formed to cover said plurality of column electrodes, so as to form display cells each having a discharge space at the intersections, respectively, wherein said drive portion applies, in a reset period, a reset pulse between row electrodes forming each of the plurality of row electrode pairs to cause reset discharge, so that a wall electric charge state in each of the discharge cells is initialized, applies, in an address period, a scanning pulse to one electrodes of the row electrode pairs and data pulses to the column electrodes in accordance with display data based on a video signal to cause a selective discharge operation for setting wall electric charge of each of the discharge cells into one of a lighting state in which wall electric charge is formed and an unlighted state in which wall electric charge is not formed; and applies, in a sustain period, a sustain pulse alternately to row electrodes forming each of the row electrode pairs to cause sustain discharge only in discharge cells set in the lighting state, wherein a one-field display period of the video signal is constituted by a plurality of subfields each including the address period and the sustain period, said drive portion causes the reset discharge in a reset period prior to an address period in a beginning subfield of the one-field display period, and applies other two sustain pulses to row electrodes forming each of the row electrode pairs in an erasure period after ending a sustain period in a last subfield of the one-field display period to thereby cause erasure discharge within discharge cells where the sustain discharge has been caused in the last subfield, the two sustain pulses having rise timings different from each other by a predetermined period of time, and having partly overlapping application periods, and wherein said magnesium oxide layer is formed by magnesium oxide crystals adhered onto the dielectric layer to face the discharge space in each of the display cells, the magnesium oxide crystals having a characteristic to emit cathode luminescence light having a peak in a wavelength band of 200 to 300 nm when excited by electron-beam irradiation.

2. The plasma display device according to claim 1, wherein said magnesium oxide crystals having a particle diameter of 2000 angstrom or greater.

* * * * *